US006260219B1

(12) United States Patent
Bartosik

(10) Patent No.: US 6,260,219 B1
(45) Date of Patent: Jul. 17, 2001

(54) BEACH BLANKET WITH CORNER POCKETS

(76) Inventor: Andrew P. Bartosik, 236 Edgebrook Rd., Wood Dale, IL (US) 60191

( * ) Notice: Subject to any disclaimer, the term of this patent is extended or adjusted under 35 U.S.C. 154(b) by 0 days.

(21) Appl. No.: 09/272,186

(22) Filed: Mar. 18, 1999

(51) Int. Cl.[7] ..... A47G 9/06
(52) U.S. Cl. ..... 5/417; 5/485
(58) Field of Search ..... 5/417, 485, 418, 5/419, 420

(56) References Cited

U.S. PATENT DOCUMENTS 3,226,737 * 1/1966 Rote ..... 5/417
4,654,906 * 4/1987 Roberts ..... 5/417
5,482,374 * 1/1996 Buhyoff ..... 5/417 X
5,499,411 * 3/1996 Wong ..... 5/417
5,520,364 * 5/1996 Bloxson et al. ..... 5/417 X

* cited by examiner

*Primary Examiner*—Lynne H. Browne
*Assistant Examiner*—Frederick Conley
(74) *Attorney, Agent, or Firm*—Sidney N. Fox

(57) ABSTRACT

An eight-sided beach blanket having integral pockets is disclosed herein. The beach blanket has a main body section, elongated edges, top and bottom edges, and slanted edges. The beach blanket has pockets located at its slanted edges. The pockets may be sealed by a zipper or VELCRO® tape. The pockets may be formed by folding the corners of the beach blanket inward and sewing the perimeter of the corners to the surface of the main body section of the beach blanket.

17 Claims, 3 Drawing Sheets

FIG. 1
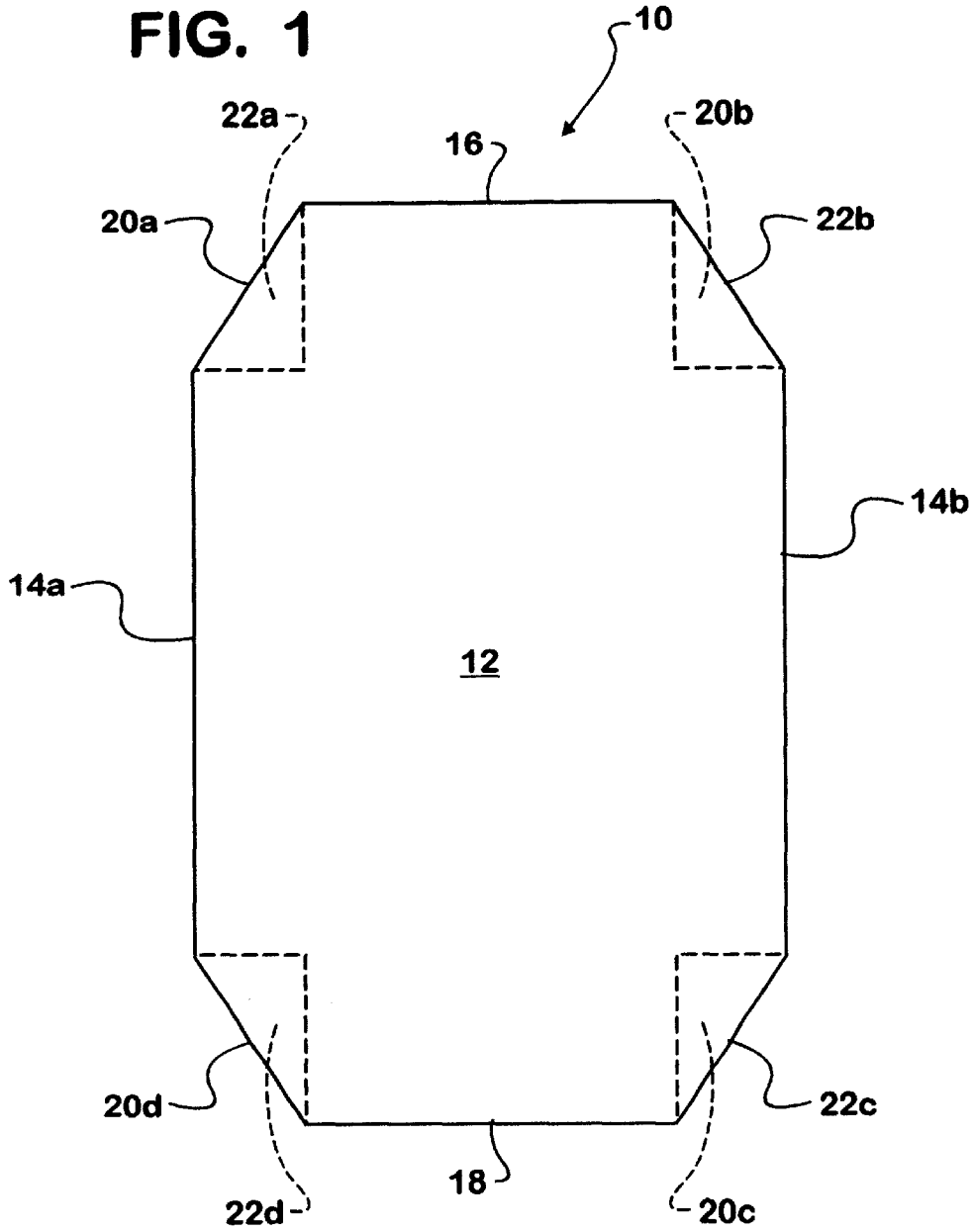
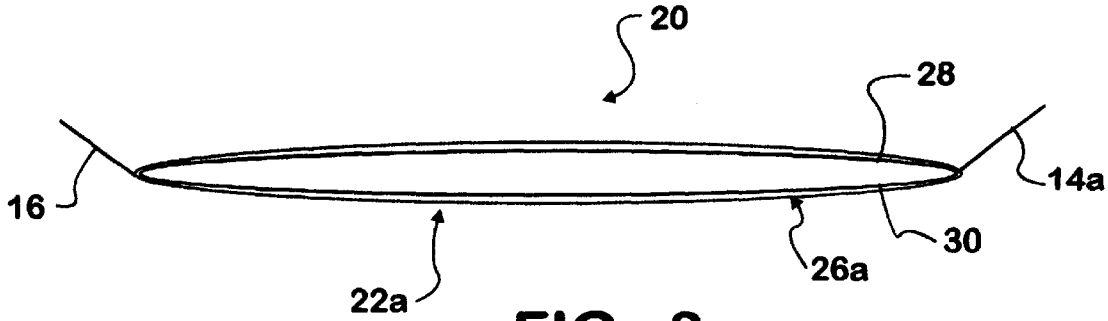
FIG. 3

BEACH BLANKET WITH CORNER POCKETS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a beach blankets. More specifically, the present invention relates to a beach blankets with pockets.

2. Description of the Related Art

Beach blankets have been a necessary part of outdoor swimming activities for many years. The beach blanket provides a soft surface upon which an individual may relax after swimming or use for sunbathing. The blankets are often at least the length of a person, and may be large enough to accommodate two or more persons.

While at a beach, pool or park, the individual often is without a place to store items such as keys, a wallet, lipstick or the like. For one or more reasons, leaving the items in sight of others may not be prudent. Additionally, carrying items to a beach, pool or park necessitates a storage compartment.

Some beach blankets of the prior art have put forth creative ways to enhance a beach blanket but have not addressed the above-mentioned desires. One example of an enhancement of a beach blanket is Roberts, U.S. Pat. No. 4,654,906, for a Beach Blanket With Sand Pockets. Roberts discloses a beach blanket of a rectangular shape having four pockets at the corners for holding sand. The main objective of Roberts is to anchor the corners of the beach blanket without sacrificing surface area of the beach blanket. Thus, the corners are not folded, and the pockets are formed between two layers of the beach blanket. A piece of string is provided to tie-off the pocket after sand is placed within it. Alternatively, VELCRO® tape may be used to seal off the pocket. The beach blanket of Roberts is a multilayer blanket. Another beach blanket is described in Rote, U.S. Pat. No. 3,226,737 for a Beach And Picnic Blanket. The main object of Rote is to provide a beach blanket that may be secured to the ground. The pockets of Rote are disposed at the corners of the rectangular blanket, and are filled with sand or rocks. The pockets may be closed with string or the like.

Yet another example of a beach blanket is Wilke, U.S. Pat. No. 5,443,880 for a Pocket-Containing Towel Or Blanket. Wilke describes a blanket with pockets for storage of articles. The pockets of the Wilke blanket are formed by attached cloth to one corner of the rectangular blanket.

BRIEF SUMMARY OF THE INVENTION

It is an object of the present invention to provide a beach blanket with pockets.

It is an additional object of the present invention to provide a beach blanket with pockets formed from inward folded corners of a rectangular blanket.

It is an additional object of the present invention to provide an eight-sided beach blanket with pockets at four of the sides.

One aspect of the present invention is a beach blanket having a main body section, two elongated edges, a top edge, a bottom edge and four slanted edges. The first and second elongated edges are parallel and on opposite sides of the main body section. The top and bottom edges are parallel and at opposite ends of the main body section. The first slanted edge is juxtaposed by the first elongated edge and the top edge. The second slanted edge is juxtaposed by the top edge and the second elongated edge. The third slanted edge is juxtaposed by the second elongated edge and the bottom edge. The fourth slanted edge is juxtaposed by the bottom edge and the first elongated edge. The beach also has first, second, third and fourth pockets disposed at the first, second, third and fourth slanted edges respectively. The opening of each pocket corresponds to each respective slanted edge. Each pocket has means for sealing and unsealing the opening of the pocket.

The pockets may be created from the folding of the corners of the beach blanket to create the slanted edges. The sealing means may be a zipper or VELCRO. Each of the pockets may have a substantially triangular interior. The beach blanket may be composed of cotton or some other fabric.

Another aspect of the present invention is an eight-sided beach blanket. The eight-sided beach blanket has a main body section. Four of the sides have a first length. Two of the sides have a second length. The two remaining sides have a third length. None of the sides of equal length are adjacent to one another. The eight-sided blanket also has first, second, third and fourth pockets disposed at each of the four sides of the first length respectively. The opening of each pocket corresponds to each respective side of the first length. Each pocket has means for sealing and unsealing the opening of the pocket.

Each of the pockets of the eight-sided beach blanket may be created from the folding of the corners of the beach blanket to create the four sides of the first length. The sealing means of the eight-sided beach blanket may be a zipper or VELCRO VELCRO is a registered trademark of Velcro International, Inc. Each of the pockets of the eight-sided beach blanket may have a substantially triangular interior.

Another aspect of the present invention is a beach blanket having at least one pocket. The beach blanket has a main body section, two elongated edges, a top edge, a bottom edge and four slanted edges. The first and second elongated edges are parallel and on opposite sides of the main body section. The top and bottom edges are parallel and at opposite ends of the main body section. The first slanted edge is juxtaposed by the first elongated edge and the top edge. The second slanted edge is juxtaposed by the top edge and the second elongated edge. The third slanted edge is juxtaposed by the second elongated edge and the bottom edge. The fourth slanted edge is juxtaposed by the bottom edge and the first elongated edge. The at least one pocket is disposed at one of the first, second, third and fourth slanted edges. The opening of the pocket corresponds to a slanted edge. The pocket has means for sealing and unsealing the opening of the pocket.

The at least one pocket may be created from the folding of a corner of the beach blanket to create one of the slanted edges. The sealing means for the at least one pocket may be a zipper or VELCRO. The at least one pocket may have a substantially triangular interior. The beach blanket having at least one pocket may have a second pocket disposed on one of the other of the first, second, third and fourth slanted edges. The beach blanket having at least one pocket may have second and third pockets. The second and third pockets disposed at separate slanted edges from each other and from the at least one pocket.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

There is illustrated in FIG. 1 a top plan view of a beach blanket of the present invention.

There is illustrated in FIG. 2 an isolated plan view of a corner of the beach blanket of FIG. 1.

There is illustrated in FIG. 3 an isolated side view of a pocket of the beach blanket of the present invention.

Figure 4:
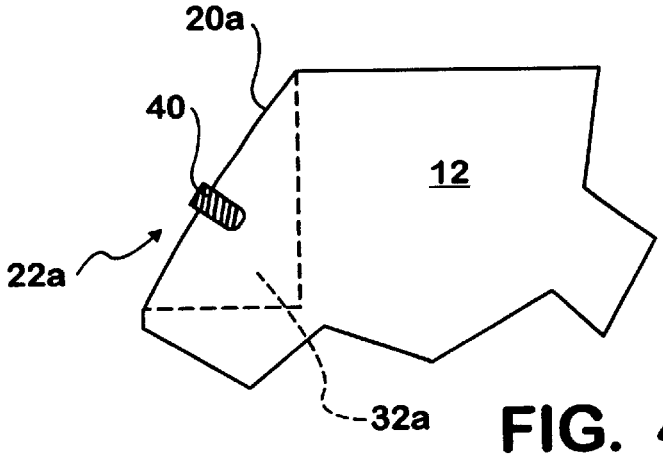

There is illustrated in FIG. 4 an isolated plan view of the corner of the beach blanket with a clip to seal the pocket.

Figure 5:
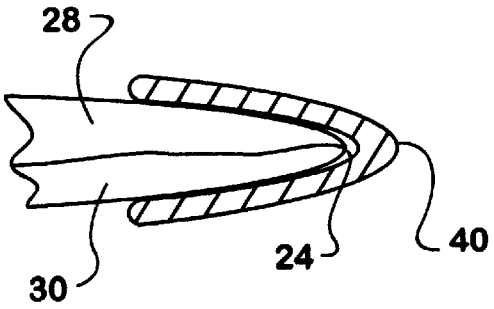

There is illustrated in FIG. 5 a cross-sectional view of a clip sealing the pocket of the beach blanket of the present invention.

Figure 6:
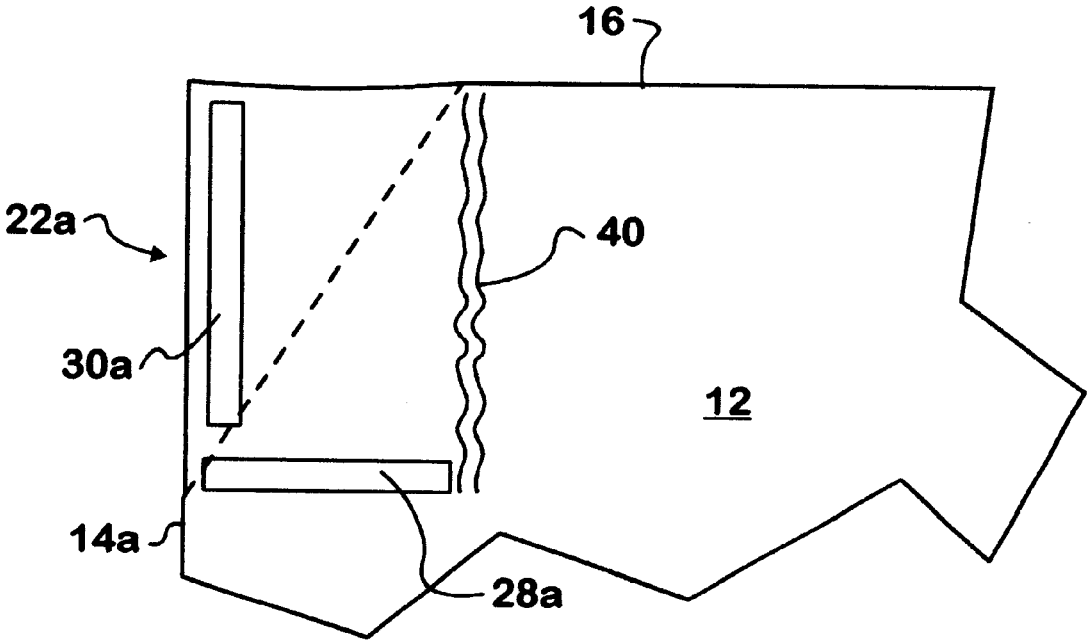

There is illustrated in FIG. 6 an isolated plan view of the corner of the beach blanket prior to folding to fabricate the pocket.

Figure 7:
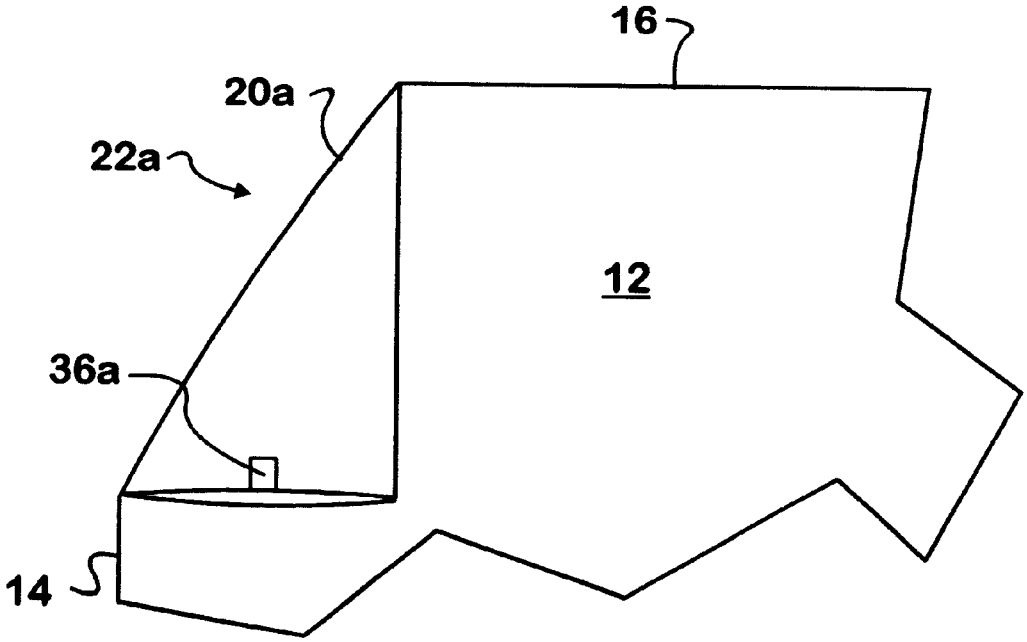

There is illustrated in FIG. 7 an isolated plan view of the corner of the beach blanket after the corner has been folded over to fabricate the pocket.

DETAILED DESCRIPTION OF THE INVENTION

As shown in FIG. 1, a beach blanket of the present invention is generally designated 10. The beach blanket 10 may be composed of a fabric such as cotton. The beach blanket 10 includes a main body section 12, first and second elongated edges 14*a–b,* a top edge 16, a bottom edge 18, and four slanted edges 20*a–d.* The first and second elongated edges 14*a–b* are parallel to each other, and may have the same length. The first elongated edge 14*a* and the second elongated edge 14*b* are on opposite sides of the main body section 12. The top edge 16 and the bottom edge 18 are parallel to each other, and may have the same length. The top edge 16 and the bottom edge 18 are at opposite ends of the main body section 12. The length of either of the top edge 16 or the bottom edge 18 is less than the length of either of the first or the second elongated edges 14*a–b.* The slanted edges 20*a–d* may all have the same length. The length of any of the slanted edges 20*a–d* is less than the length of either of the top edge 16 or the bottom edge 18. The first slanted edge 20*a* is juxtaposed by the first elongated edge 14*a* and the top edge 16. The second slanted edge 20*b* is juxtaposed by the top edge 16 and the second elongated edge 14*b.* The third slanted edge 20*c* is juxtaposed by the second elongated edge 14*b* and the bottom edge 18. The fourth slanted edge 20*d* is juxtaposed by the bottom edge 18 and the first elongated edge 14*a.*

Figure 2:
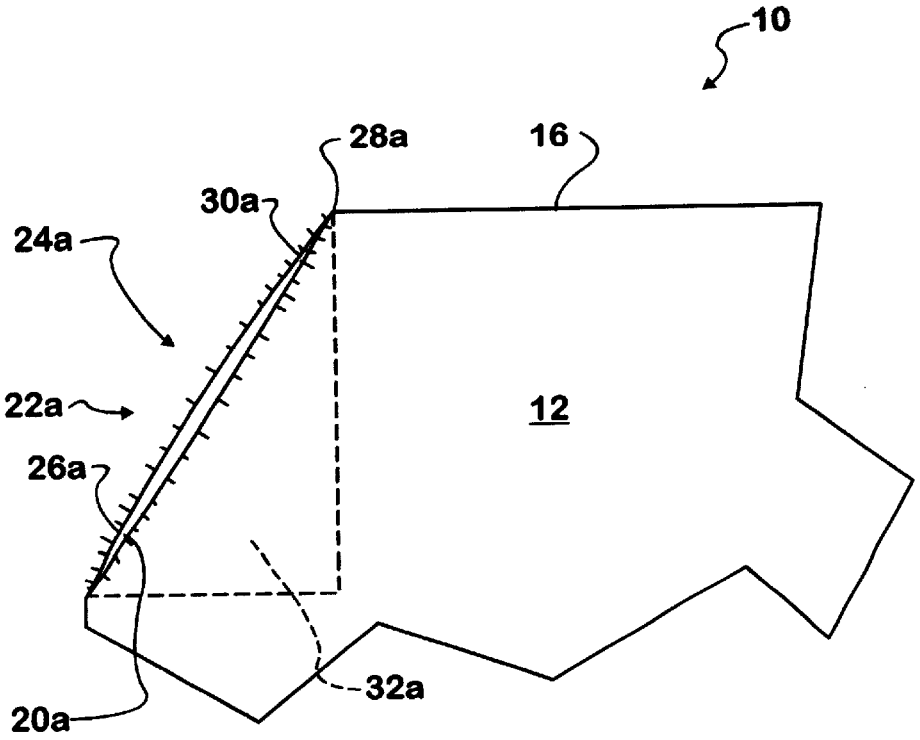

At each of the slanted edges 20*a–d* is a pocket 22*a–d.* As best seen in FIGS. 2 and 3, the pockets 22*a–d* may be formed by folding the corners of a rectangular blanket inward and sewing the perimeter of the folded corners to the surface of the beach blanket 10 that will be facing the sand or ground. The portion of the folded corners corresponding to the slanted edges 20*a–d* is slit open to provide openings 24*a–d* for each of the pockets 22*a–d.* The openings may extend along the entire length of each of the slanted edges 20*a–d.* Alternatively, the openings 24*a–d* may only extend along a portion of each of the slanted edges 20*a–d.*

Each of the openings may be provided with means for sealing and unsealing the openings 24*a–d.* The resealable means 26*a–d* may be a zipper or VELCRO® tape (cross and stitch hatching). Each of the resealable means 26*a–d* is sewn to the beach blanket 10 at one of the slanted edges 20*a–d.* One portion 28 of the resealable means 26*a–d* is attached to a corresponding slanted edge 20*a–d,* and another portion 30 of the resealable means 26*a–d* is attached to the bottom edge of the corresponding pocket 22*a–d.* Each of the pockets may have a triangular interior 32*a–d.* FIGS. 4 and 5 illustrate another variation of the sealing means 24 for the pocket 20. A clip 40, which may be a VELCRO® clip, is shown sealing the pocket 22.

In an alternative embodiment, the pockets 22*a–d* may be sewn to the beach blanket 10 and not formed from the corners of the beach blanket 10. In such an embodiment, the pockets 20*a–d* may be composed of an entirely different material such as a water-resistant material.

FIGS. 6 and 7 illustrate another fabrication method for fabricating the beac blanket of the present invention. In this embodiment, glue 40 is spread on one portion of the main body section, and VELCRO® tape 28 and 30 are positioned at the corner of the main body section 12. The corner is folded over to create the pocket 22*a* with a fabric loop 36 for closing the pocket 22*a*. The entire opening to the pocket is sealed to prevent stand from falling out of the pocket 22*a*.

The eight-sided beach blanket 10 may also only have a pocket 22 at one of the slanted edges 20. Alternatively, the eight-sided beach blanket 10 may have two pockets 20*a–b* at two of the slanted edges 20*a–b.* Further, the eight-sided beach blanket 10 may have three pockets 20*a–c* at three of the slanted edges 20*a–c.* Also, the beach blanket 10 may have some of the pockets 20*a–d* formed from the corners of the beach blanket 10, and some of the pockets composed of a different material that is sewn to the beach blanket 10.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A beach blanket comprising a main body section having top and bottom surfaces. first and second elongated edges defining at least one corner, said corner being foldable over one of said top and bottom surfaces of said main body section forming an overlap over said main section having a closed slanted edge and a pair of opposite side edges, at least one of said side edges being sealing secured to said one of said top and bottom surfaces and the other one of said side edges being open to the horizontal plane of said one of said top and bottom surfaces defining a pocket opening toward said horizontal plane of said main body section and selectively releasable closure means secured to said main body section at a location along said pocket opening for sealing and unsealing said opening of said pocket, said pocket facing inward and opening toward a longitudinal line along the center of the main body section.

2. The beach blanket according to claim 1 wherein each of the pockets has a substantially triangular interior.

3. The beach blanket according to claim 1 wherein the beach blanket is composed of cotton.

4. A beach blanket comprising a main body section having top and bottom surfaces, first and second parallel elongated sides on opposite sides of said main body section defining at least one corner, said one corner being foldable over one of said top and bottom surfaces to define an overlap having a closed slanted edge and a pair of side edges, one of said side edges being sealably secured to said main body section and said other one of said side edges opening whereby to define a pocket opening along a horizontal plane of said main body section and selectively releasable closure means secured to said main body section adjacent said other one of said side edges sealing and unsealing said pocket.

5. The beach blanket according to claim 4 in which said closed slanted edge is along one of said elongate edges.

6. The beach blanket according to claim 4 in which said other one of said side edges opens toward the second parallel elongate edge of said main body section and said one of said side edges is sealingly secured to said main body section along a lone parallel to said first elongate edge of said blanket, said selectively releasable closure means being located along said other one of said side edges.

7. The beach blanket according to claim 4 which said slanted edge is slit along at least a portion of its length and opens outward of said first elongate edge, said selectively releasable closure means is disposed along the length of said slit and both side edges of said overlap are secured sealingly to said main body section.

8. The beach blanket according to claim 4 in which said overlap extends over one of the top and bottom surfaces of said beach blanket.

9. The beach blanket according to claim 4 in which said main body section is rectilinear in configuration and has four corners, each corner being foldable to form said overlap.

10. The beach blanket according to claim 4 in which said closure means comprise one of a zipper and a "hook and pile" closure.

11. The beach blanket according to claim 4 in which said overlap is on the bottom of said main body section.

12. The beach blanket according to claim 4 in which purchase means are secured to the opening of said pocket, said purchase means comprising a fabric loop for unsealing said pocket.

13. A beach blanket with corner pockets comprising a main body section having eight sides, four of said sides having a first elongate length, two of said sides having a second longitudinal length and two of said sides having a third longitudinal length, said four sides each defining a corner, each corner being foldable forming an overlap extending inward and over said main body section, each overlap having a folded slanted edge along the first longitudinal edge thereof and a pair of like side edges together defining a pocket, one of said pair of side edges of each overlap being sealingly secured to said main body section along the length thereof and the other one of said side edges defining an opening directed toward the horizontal plane of said main body section, selectively opening closure means secured along said other one of said side edges of said other one of said side edges of said overlaps, none of said elongate sides of equal length being next adjacent the other elongate sides of equal length.

14. The beach blanket with corner pockets according to claim 13 in which closure means comprise "hook and pile" strips.

15. The beach blanket with corner pockets according to claim 13 in which a purchase member is secured to the other one of said side edges of said overlaps adjacent the opening thereof.

16. The beach blanket with corner pockets according to claim 13 in which said main body section has a top and bottom surface, said overlaps being formed over said bottom surface of said main body section.

17. The beach blanket with corner pockets according to claim 13 which said slanted edge of at least one of said overlaps is slit along at least a portion of the length thereof to define an opening toward the exterior of said main body section and both of said side edges of said at least one of said overlaps being sealingly secured to said main body section thereof said resulting pocket being open only to the exterior of said main body section and selectively operating closure means secured to said slanted edge of said at least one of said overlaps.

* * * * *